US009589549B1

(12) United States Patent
McKay, II

(10) Patent No.: US 9,589,549 B1
(45) Date of Patent: Mar. 7, 2017

(54) ELECTRO-MECHANICAL AUDIO SIGNAL CONTROL SYSTEM

(71) Applicant: Buchanan M. McKay, II, Los Angeles, CA (US)

(72) Inventor: Buchanan M. McKay, II, Los Angeles, CA (US)

( * ) Notice: Subject to any disclaimer, the term of this patent is extended or adjusted under 35 U.S.C. 154(b) by 0 days.

(21) Appl. No.: 15/141,839

(22) Filed: Apr. 29, 2016

(51) Int. Cl.
*G10H 1/34* (2006.01)

(52) U.S. Cl.
CPC ..... *G10H 1/348* (2013.01); *G10H 2210/155* (2013.01); *G10H 2220/265* (2013.01)

(58) Field of Classification Search
CPC ..... G10D 17/00; G10D 13/006; G10H 1/32; G10H 1/34; G10H 3/186; H04S 1/005
See application file for complete search history.

(56) References Cited

U.S. PATENT DOCUMENTS 6,201,173 B1 * 3/2001 Black ..... G10D 13/006 84/104
7,851,690 B1 * 12/2010 Stahnke ..... G10F 1/02 84/723
8,686,275 B1 * 4/2014 Stahnke ..... G10F 1/02 84/718
2011/0271820 A1 * 11/2011 Cockerell ..... G10H 1/348 84/746

* cited by examiner

*Primary Examiner* — Marlon Fletcher

(57) ABSTRACT

The present invention is multi-expression control system designed to control the individual sound from one or more compact analog sound modulator systems, often called "pedals, effects or stomp boxes," or collectively herein "effects pedals," for guitars, basses and keyboards. It couples features that are proprietary with off-the shelf products resulting in a system that spans the distance between a third party foot pedal and third party effects pedals. The system gives a musician "hands free" control of any third party effects pedal that has manually controlled potentiometers during a live artistic performance.

1 Claim, 8 Drawing Sheets

ELECTRO-MECHANICAL AUDIO SIGNAL CONTROL SYSTEM

CROSS-REFERENCE TO RELATED APPLICATIONS

This application claims the benefit of U.S. Provisional Application No. 62/156,041, filed May 15, 2015.

BACKGROUND

Since the adoption of the electric guitar in pop music in the 1950's, musicians have been exploring new ways to change the timbre of their individual sound. The electrification of music led to new circuits that modify the signal and the resulting sound in many ways. Starting with the wide use of distortion for guitars in the blues and early rock-and-roll genres, then gaining steam with new effects like tremolo, echo and others that characterized the new sounds of pop music in the 1960's, popular music has never been the same.

Compact sound modulator systems, often called "pedals, effects or stomp boxes," or herein "effects pedals" entered the market decades ago. Even though new effects pedals enter the market regularly, many musicians prefer the older designs to the newer ones for their "warmer" analog qualities. Consequently, well into the digital age, analog effects pedals continue to be manufactured and collected. Nearly every analog effects box produced has at least one knob for adjusting its characteristics of the given sound effect. Traditionally, a musician adjusts this knob beforehand until he or she finds a desired level for the given sound-effect; and then, simply turns it on and off as needed during a live performance. More recently many musicians—especially modern guitar, bass, and keyboard players—can be seen adjusting these knobs in the middle of a song in order to vary their soundscapes to distinguish the different sections of the song with a sound that is pleasing to the artist and the audience.

The problem is simple: many analog effects knobs are only hand-adjustable, and a musician's hands are busy during a performance. The obvious solution is to provide a hands-free means of adjusting the knobs, so that the musician can modify any sound effects while keeping their hands on their instrument. Successful professional musicians can employ technicians who can dissect and customize any pedal to meet the artist's fickle needs, but this is expensive for the ordinary musician or hobbyist. As well, custom technical modifications require some time to complete the modifications even for artists willing to pay for customization.

By applying the increased access and cost decline of simple robotic control components, I hope to capitalize on this gap in functionality. This simple robotic mechanism will utilize a widely-used pivot-action foot-pedal (hundreds on the market since the 1960's, with which most musicians are familiar) to control this knob-adjusting device. Although there are already a few score solutions in the market today they fail to combine functionality and accessibility, especially regarding analog devices that lack digital expression ports.

SUMMARY

By applying the increased access and cost decline of simple robotic control components, this invention capitalizes on this gap in functionality between hands free control over third party effects as described in the earlier, Background of the Invention. This simple robotic mechanism will utilize a widely used pivot-action foot pedal (hundreds on the market since the 1960's, with which most musicians are familiar) to control this knob-adjusting device. Although there are already a few score solutions in the market today they fail to combine functionality and accessibility, especially regarding analog devices that lack digital expression ports.

The present invention is multi-expression control system designed to control the individual sound from one or more compact analog sound modulator systems, often called "pedals, effects or stomp boxes," or collectively herein "effects pedals," for guitars, basses and keyboards. It couples features that are proprietary with off-the shelf products resulting in a system that spans the distance between a third party foot pedal and third party effects pedals. The system gives a musician "hands free" control of any third party effects pedal that has manually controlled potentiometers during a live artistic performance. One embodiment of the invention is an audio signal multi-expression control system comprising:

a) an effects pedal having a manual potentiometer for modifying an audio output;
b) an expression pedal for providing a variable input voltage signal;
c) a controller for receiving the variable input voltage signal from the expression pedal and outputting an electrical current;
d) a motor electrically connects to the controller for receiving the outputted electrical current; and
e) a coupling coupled to the motor and the potentiometer for changing the position of the manual potentiometer in response to a change in position of the expression pedal.

The invention may further comprise an adjustable support structure for supporting the motor. Lastly, a method of operating the multi-expression control system of the invention is disclosed.

DRAWINGS

These and other features, aspects and advantages of the present invention will become better understood with regard to the following description, appended claims, and accompanying figures where:

Figure 1A:
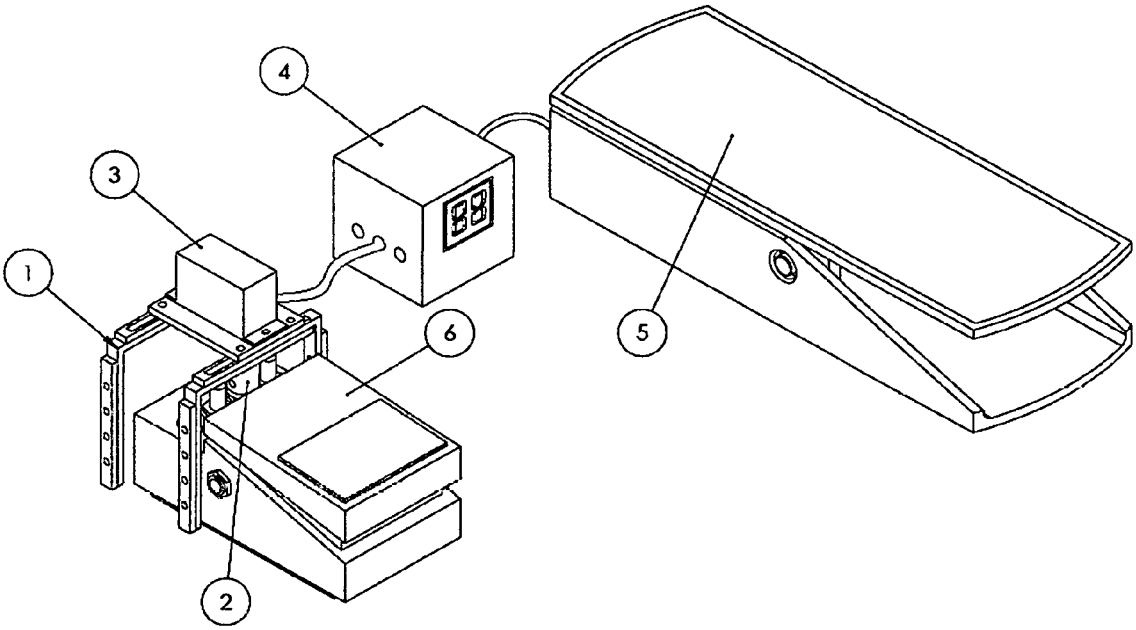
FIG. 1A is a perspective view of the control system having features of the invention.
Figure 3A:
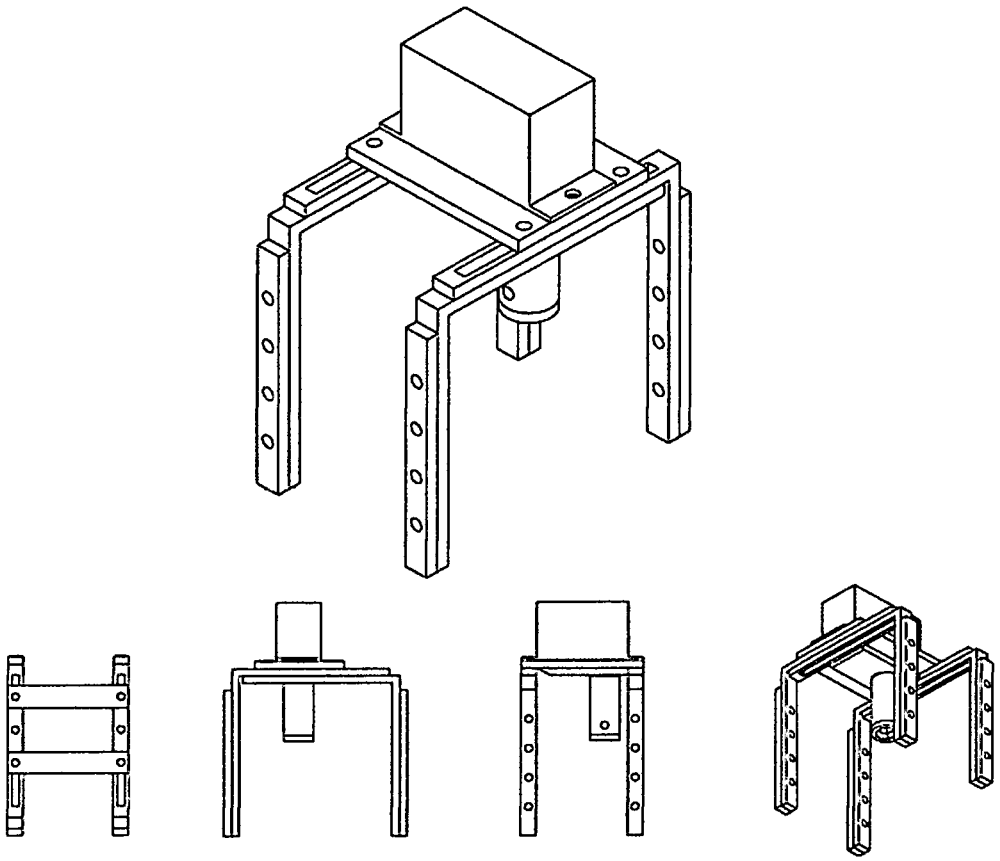
Figure 3B:
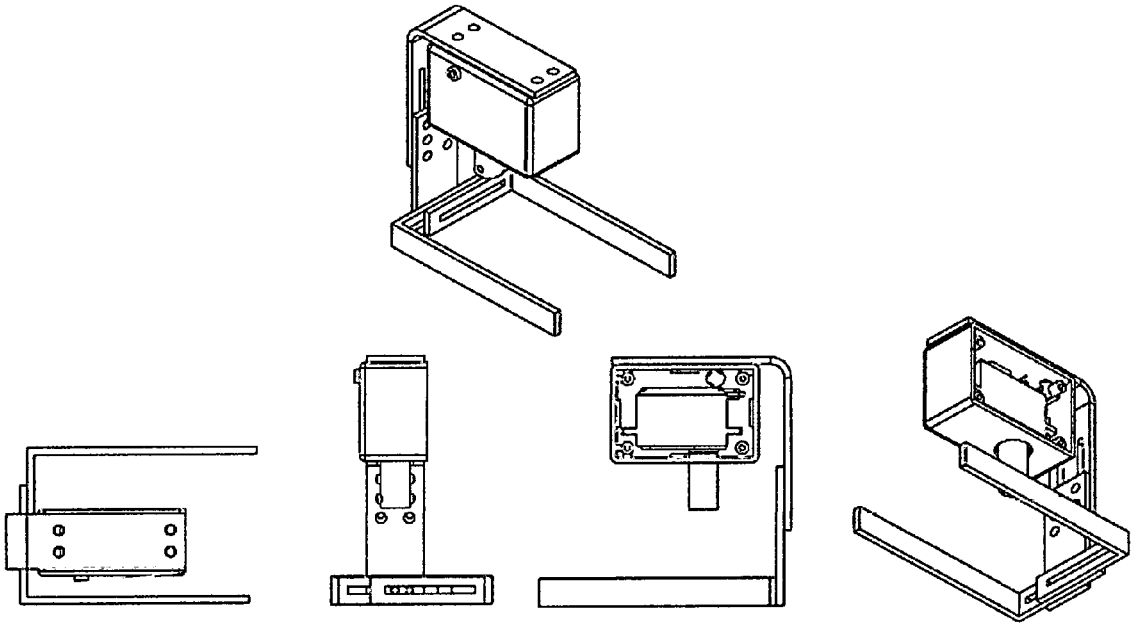
Figure 4A:
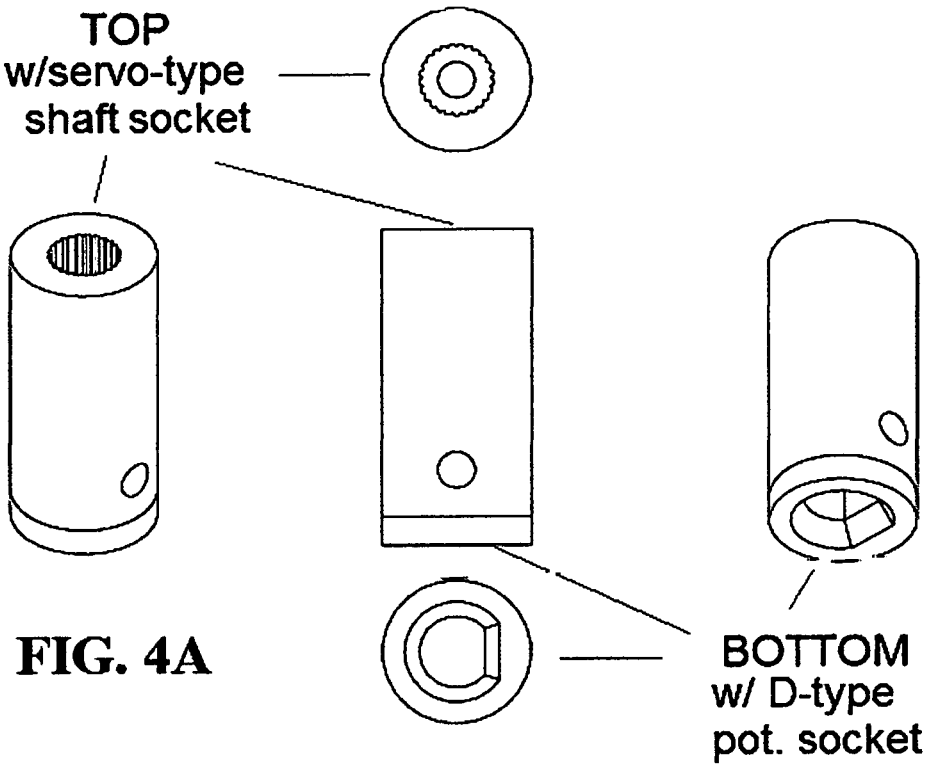
Figure 4B:
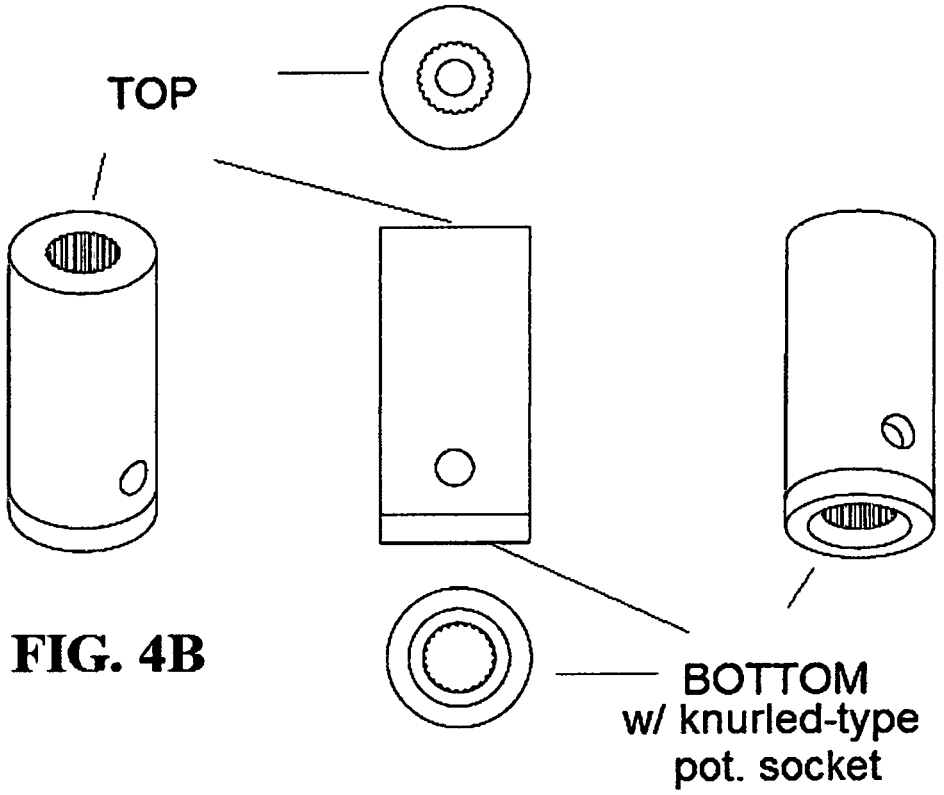
Figure 5A:
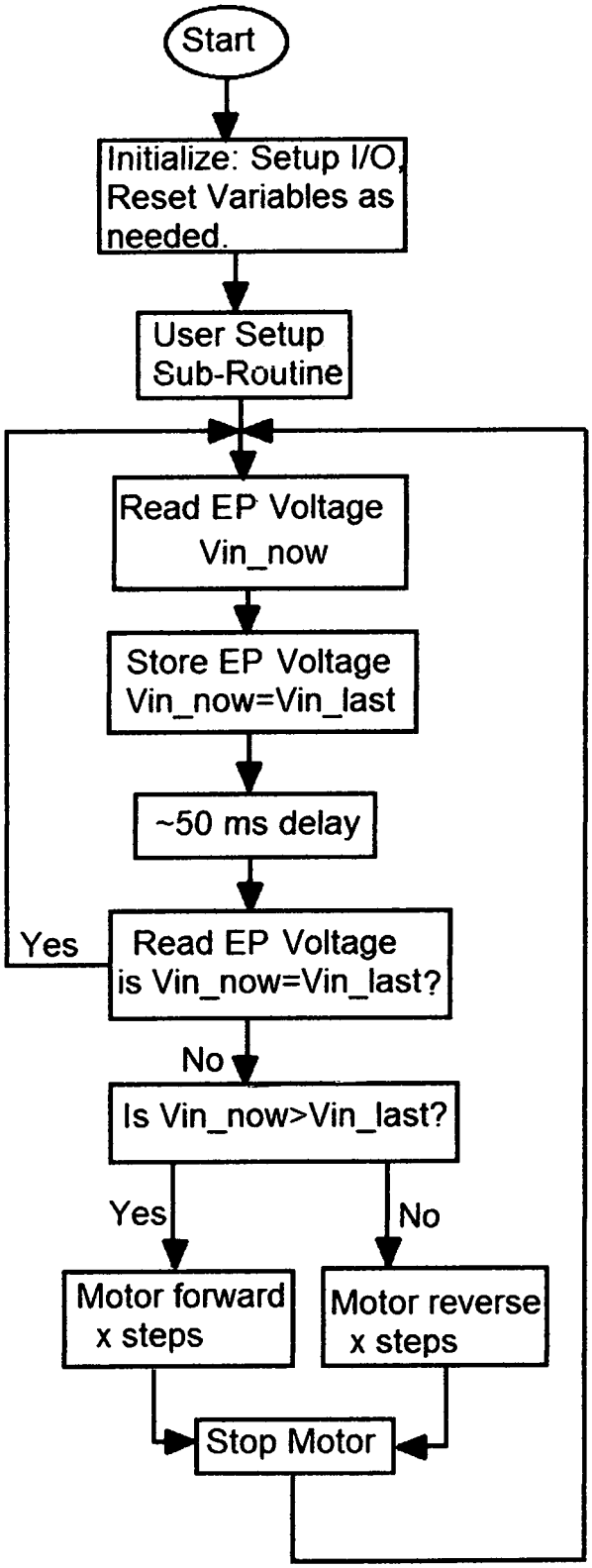
Figure 6A:
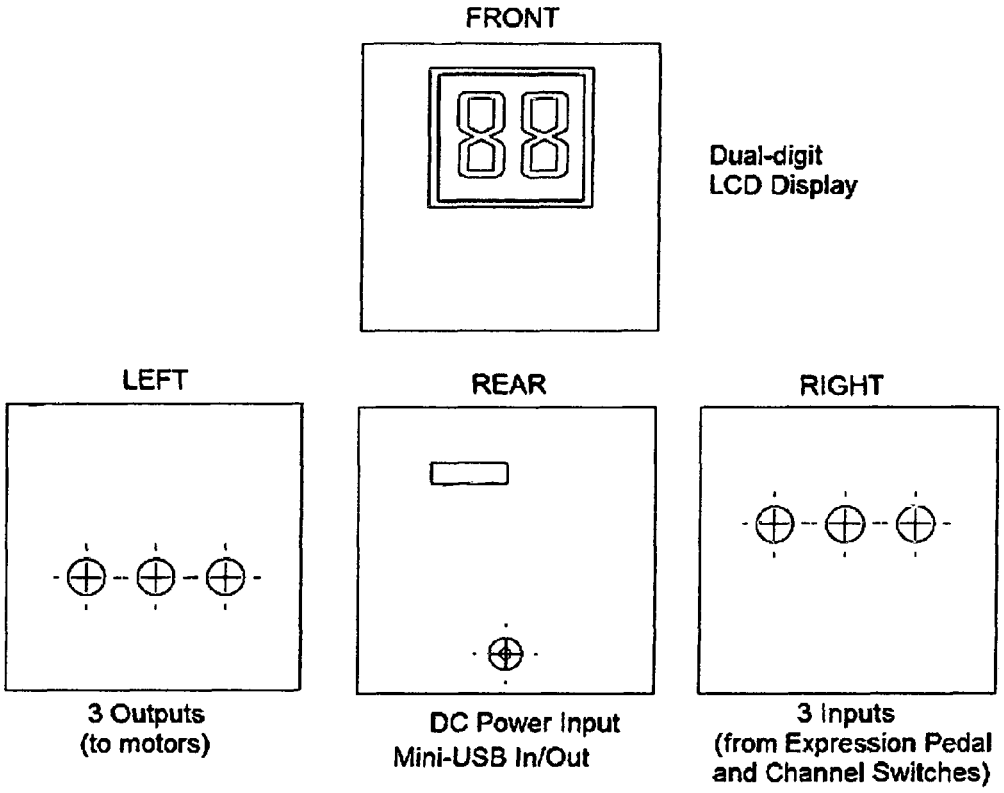
Figure 7A:
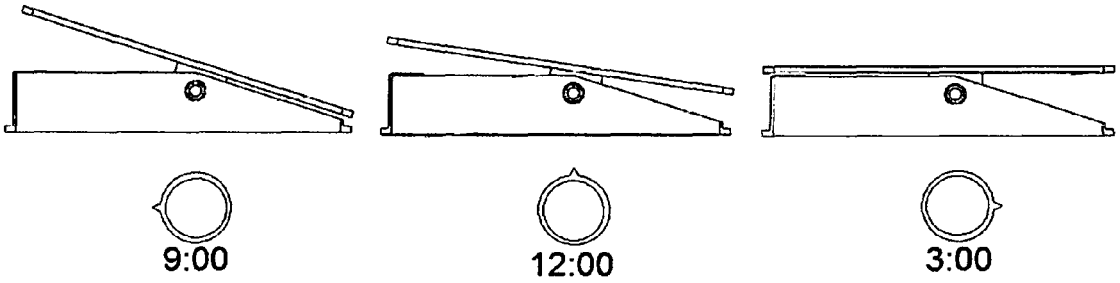
Figure 8A:
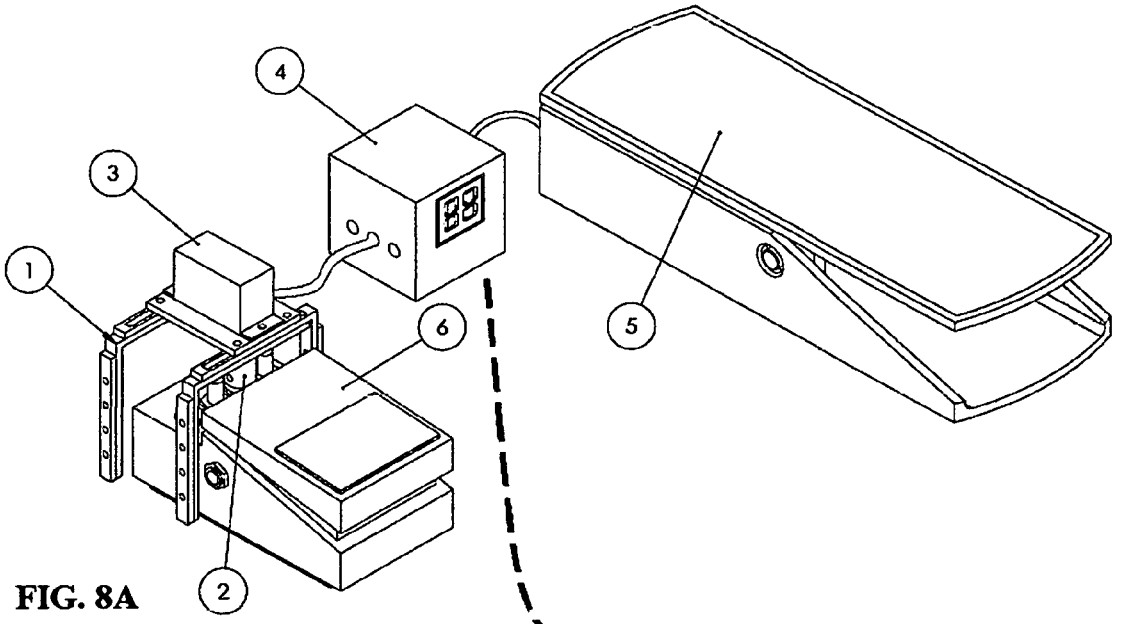
Figure 8B:
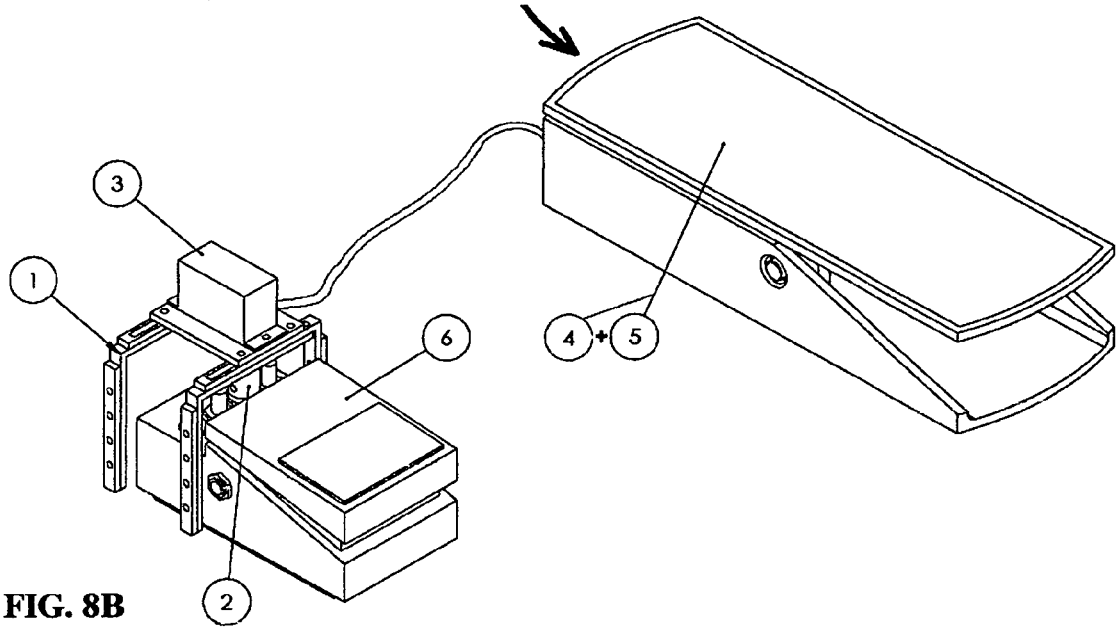

FIG. 3A-B are partial sectional views of alternative embodiments illustrating the relationship of the stand and motor and coupling device of the invention of FIG. 1A;

FIGS. 4A-B are perspective of views of two possible embodiments of a coupling hardware device of one embodiment of the invention;

FIG. 5A is a sample action code flowchart used by the system of FIG. 1A;

FIG. 6A depicts partial sectional views of the control box of FIG. 1A;

FIG. 7A illustrates in clock time the mechanism the pedal controller translates to the potentiometer of FIG. 1A; and FIGS. 8A-B are perspective views of alternative embodiments of the control system having features of the invention.

DESCRIPTION

The present invention solves the need in the prior art as a multi-expression control system designed to control the individual sound from one or more compact analog sound modulator systems, often called "pedals, effects or stomp boxes," or collectively herein "effects pedals," for guitars, basses and keyboards.

As shown in FIG. 1A, one embodiment of the invention is an audio signal multi-expression control system comprising: an effects pedal 6 having a manual potentiometer for modifying an audio output; an expression pedal 5 for providing a variable input voltage signal; a controller 4 for receiving the variable input voltage signal from the expression pedal and outputting an electrical current; a motor 3 electrically connect to the controller for receiving the outputted electrical current; and a coupling 2 coupled to the motor and the potentiometer for changing the position of the manual potentiometer in response to a change in position of the expression pedal 5. The system may further comprise an adjustable stand 1.

The system illustrated in FIGS. 1, 2, and 8 is unique and effective as regards effects pedals that can only be manipulated manually via knob-operated potentiometers, which category includes many earlier model analog devices.

The control box 4, that receives external 9V-12V power, inputs a voltage signal from a variable-voltage expression-pedal/foot-pedal 5 and analyzes this signal using an onboard microcontroller. Expression pedals are well known in the art. One example that can be utilized with the system of the invention is a passive expression pedal that produces no power. The passive pedal receives an output voltage from the microcontroller, then passes the voltage through the variable resistor inside the expression pedal, returning a variable voltage (0-5V is common) signal back to the microcontroller where that variable range will be analyzed by the software. Another possible expression pedal suitable for the invention is an active expression pedal that provides its own power. The active expression pedal provides a variable voltage directly to the microcontroller where that variable range will be analyzed by the software.

Various controllers are envisioned and are well known in the art. One example of a controller that can be used in one embodiment of the invention is the Adafruit Trinket Mini-Microcontroller 5V (www.adafruit.com). The microcontroller within the control box interprets the input voltage signal and translates it to a proportional/other desired output current/voltage signal that will drive an electric motor 3. The motor is attached by gears to the control wheel. As the motor rotates, the potentiometer's resistance changes, so the control circuit can precisely regulate how much movement there is and in which direction. For example the control described above "Servos" are controlled by sending an electrical pulse of variable width, or pulse width modulation (PWM), through the control wire. There is a minimum pulse, a maximum pulse and a repetition rate. A servo motor can usually only turn 90° in either direction for a total of 180° movement. The motor's neutral position is defined as the position where the servo has the same amount of potential rotation in the both the clockwise or counter-clockwise direction. The PWM sent to the motor determines the position of the shaft, and based on the duration of the pulse sent via the control wire the rotor will turn to the desired position. The servo motor expects to see a pulse every 20 milliseconds (ms) and the length of the pulse will determine how far the motor turns. For example, a 1.5 ms pulse will make the motor turn to the 90° position. Shorter than 1.5 ms moves it to 0° and any longer than 1.5 ms will turn the servo to 180°, When the shaft of the motor is at the desired position, power supplied to the motor is stopped. If not, the motor is turned in the appropriate direction. The desired position is sent via electrical pulses through the signal wire. The motor's speed is proportional to the difference between its actual position and desired position. So if the motor is near the desired position, it will turn slowly, otherwise it will turn fast. This is called proportional control. This means the motor will only run as hard as necessary to accomplish the task at hand, a very efficient little guy.

The electric motor shaft is rigidly affixed to a potentiometer by way of a hardware coupling 2 that will allow motor rotation to be matched on the potentiometer (located atop effects pedal 6 in FIG. 1A). The hardware coupling 2 can be roughly cylindrical and come in various configurations, with a female socket on one end to rigidly fit various electric-motor (servo or stepper) shafts, and a different female socket on the other end to rigidly fit over various third-party potentiometer heads/shafts. The electric motor 3 can be physically/rigidly supported by an adjustable stand 1 that allows repositioning of said motor and coupling so that the shaft-axis of said motor and center-axis of said coupling will be in-line with the effects pedal-potentiometer axis.

Figure 2A:
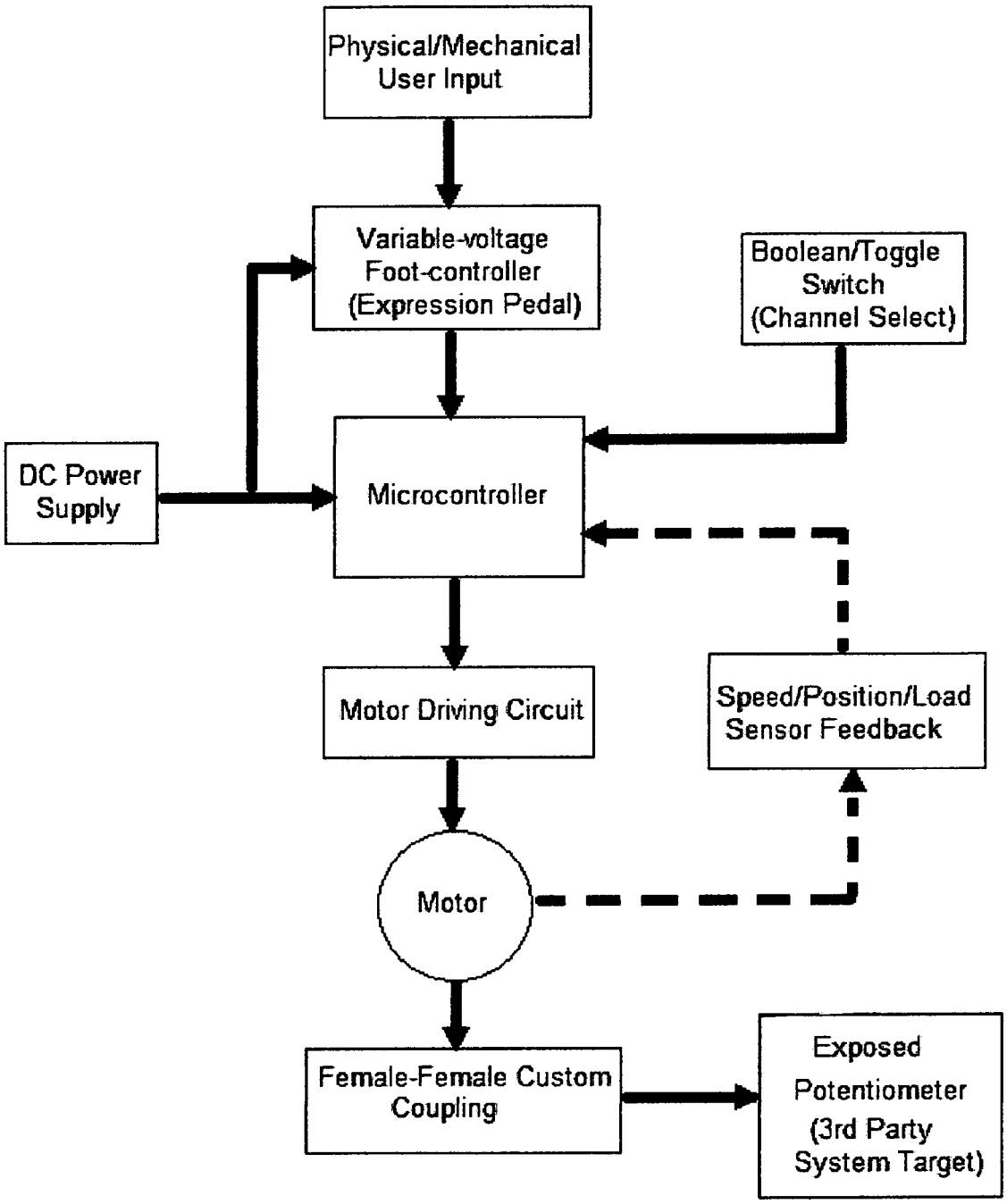
FIG. 2A is a flow diagram detailing the inter-relationship among users, the system, and third party products operating a system having features of the invention.

FIG. 2A provides further detail about the inter-relationships among users, the system and third party products. The product offers the full functionality of a professional customization job, at a reasonable cost per unit. While a custom modification must be made on each individual pedal, this product can be attached to the potentiometer of any pedal in a musician's arsenal without internal modifications of those devices. Even the most novice hobbyist can recreate a full spectrum of sound just like the big stage bands by using this product. Such versatility will even attract the established artists, once they realize the instant-gratification of sound experimentation they can achieve by not having to wait weeks for a custom modification. Best of all, this controller has a modular design so that one control box can be used to power as many knobs (additional motors sold separately) as the musician desires via a simple channel-select button.

The Rigid Adjustable Stand is well known in the prior art. FIG. 3A provides views of the stand, along with illustrations of its relationship with the motor and the coupling device, and can clamp to the effects pedal 6 to prevent unwanted rotation of the effects pedal 6 when the coupling 2 rotates. Furthermore, coupling 2 hardware is well known in the art. The coupling 2, that links the servo/stepper motor shaft to the shaft of the potentiometer, is adapted to fit the servo/stepper motor and the shaft. (FIG. 4A).

Controller software can be programmable by the inventor for each potential use and be adapted by instruction to users. (FIG. 5A). It is anticipated that the controller software will be available by open source to purchasers of the system.

FIG. 5A is the Sample Action Code Flowchart, handled by an onboard microcontroller inside control box. EP=expression pedal. For a sample of Setup Sub-Routine, see BEGIN.SETUP.CODE below.

The Control Box (FIG. 6A) which houses the controller 4 is the core of the system and provides the controllable levels of movement of the effects pedal potentiometer from the foot pedal (for which example adjustments are shown in FIG. 7A).

FIG. 7A is an example of how the Foot Pedal/Expression Pedal controller (user input) translates to various levels on the third-party potentiometer (hereby relates the pedal foot-plate angle to the knob position, given in clock time). This example shows that 45 degrees of foot pedal tilt yields 180 degrees of potentiometer rotation. This ratio will in fact be adjustable through software-enabled settings.

FIG. 8A shows an alternate configuration that has the control box (4) embedded inside the body of a custom-made expression foot-pedal (FIG. 8A) as opposed to external control box (FIG. 8A).

This device can be used on amplifiers and mixing-boards, or other instrumentation used by musicians and sound engineers. The nature of the device, which allows for intelligent hands-free control of the knobs of any third-party device, will also be explored in other industries such as biomedical applications (ex. amputees who want to adjust dials/knobs on their appliances). Though the preferred control interface will be a foot-pedal controller, other simple mechanical linear and rotational devices could also be used to generate the input signal by intelligent human manipulation of any controllable human body part.

Described below is one example of the basic microcontroller code logic that can be used with one embodiment of the invention:

/BEGIN.SETUP.CODE

//MSG=message/instructions to user, not necessarily handled by software

1. MSG: User has already attached all hardware (w/third-party effects potentiometer in the minimum desired interactive position, EFFmin.
2. MSG: User powers on microcontroller (MC)
3. MC outputs (Pin1) control voltage (CV) to connected expression pedal (EP) input.
4. MSG: User sets EP to minimum position (EPmin)
5. CV passes through resistor in EP, returns—MC receives (Pin2) minimum voltage value, Vmin, from EP.
6. MSG: User presses Boolean switch/toggle switch (TS) once.
7. MC receives TS signal indicator (Pin3)—was set to 0, now set to 1.
8. MC Stores this current voltage value as low end of possible range, Vmin
9. MC stores current servo position (from feedback at Pin5), SPNow, as minimum servo position (SPmin)
10. Indicator LED 1 blinks quickly due to rapidly alternating (~500 ms delay) hi/low voltage signal from MC (Pin4)
11. MSG: User sets EP to maximum position (EPmax)
12. CV passes through resistor in EP, returns—MC receives (Pin2) maximum voltage value, Vmax, from EP.
13. MSG: User depresses Boolean switch/toggle switch (TS) a second time.
14. MC receives TS signal indicator (Pin3)—was set to 1, now set to 0.
15. MC Stores this current voltage value as high end of possible range, Vmax.
16. MC stores current servo position as maximum servo position (SPmax)
17. Indicator LED 1 blinks slowly for short duration (~3 seconds) due to slow alternating (~1000 ms delay) hi/low voltage signal from MC (Pin4).
18. MC maps VinRange to full position range of servo SPRange, SPRange=SPmax−SPmin).
19. MP stores input voltage range (VinRange) as: VinRange=Vmax−Vmin.

/END.SETUP.CODE

/BEGIN.ACTION.CODE

//SEE APPENDIX>ACTION CODE FLOW-CHART

20. MC sends CV to EP continuously checking value of current voltage signal from EP, VinNow, and mapping this value to a relative output value, SPTarget, within SPRange. [VinNow/VinRange=SPTarget/SPRange].
21. MC sends PWM signal (Pin6) to servo until SPNow=SPTarget.

/END.ACTION.CODE

Described below is one example of the basic microcontroller code that can be used with one embodiment of the invention (Open source code below taken from: http://www.arduino.cc/en/Tutorial/Knob)

BEGIN SAMPLE CODE

```
//controlling a servo position using a potentiometer (variable resistor)
//by Michal Rinott <http://people.interaction-ivrea.it/m.rinott>
#include <Servo.h>
Servo myservo; //create servo object to control a servo
int potpin=0; //analog pin used to connect the potentiometer
int val; //variable to read the value from the analog pin
void setup( )
{
  myservo.attach(9); //attaches the servo on pin 9 to the servo object
}
void loop( )
{
  val=analogRead(potpin); //reads the value of the potentiometer (value between 0 and 1023)
  val=map(val, 0, 1023, 0, 179); //scale it to use it with the servo (value between 0 and 180)
  myservo.write(val); //sets the servo position according to the scaled value
  delay(15); //waits for the servo to get there
}
```

END SAMPLE CODE

There are various possibilities with regard to the level of integration of the various components. In the various embodiments the device may be all-in-one where the audio signal processor and the rest of the system are implemented on a single board, while in other embodiments the audio signal processor is a separate device that connects to the rest of the system through a standardized interface and is therefore inter-changeable with other audio signal-processors sharing the same interface.

There are various possibilities with regard to the type of processor employed. In the various embodiments if may be a general purpose microprocessor, embedded processor, micro-controller, audio signal processor, or a digital signal processor.

There are various possibilities with regard to the arrangement of FLASH, RAM, NVRAM, ADC, and GPIO. Any one or more of these items may be included in the processor as in, for example, an embedded microprocessor or microcontroller.

Although the present invention has been described with a degree of particularity, it is understood that the present disclosure has been made by way of example and that other versions are possible. As various changes could be made in the above description without departing from the scope of the invention, it is intended that all matter contained in the above description or shown in the accompanying drawings shall be illustrative and not used in a limiting sense. The spirit and scope of the appended claims should not be limited to the description of the preferred versions contained in this disclosure.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means" or "step" clause as specified in 35 U.S.C. §112.

Features

A. An audio signal multi-expression control system comprising:

a) an effects pedal having a manual potentiometer for modifying an audio output;

b) an expression pedal for providing a variable input voltage signal;

c) a controller for receiving the variable input voltage signal from the expression pedal and outputting an electrical current;

d) a motor electrically connect to the controller for receiving the outputted electrical current; and e) a coupling coupled to the motor and the potentiometer for changing the position of the manual potentiometer in response to a change in position of the expression pedal.

A-1 Feature A further comprising an adjustable support structure for supporting the motor.

A-2 A method of operating the multi-expression control system of Feature A.

I claim:

1. An electro-mechanical potentiometer control system for audio-signal modification, comprising: a variable-voltage input device for physical user input control; a rotational actuator that rigidly attaches to a potentiometer for the purpose of controlling the rotation of said potentiometer; a physical coupler that rigidly connects along a common rotational axis with both said rotational actuator and said potentiometer and thereby translates the actuator's rotation directly to said potentiometer; a micro-processor for receiving the input signal and translating said input signal into a user-specified output signal that controls said rotational actuator; and, a stand for the actuator assembly that is adjustable such that said stand can suspend said actuator and said coupler in a position convenient to attaching said coupler to said potentiometer that is to be controlled.

* * * * *